United States Patent [19]

Fujimoto

[11] Patent Number: 4,894,490

[45] Date of Patent: Jan. 16, 1990

[54] HIGH TENSION CABLE AND METHOD OF MANUFACTURE THEREOF

[75] Inventor: Terutsugu Fujimoto, Suzuka, Japan

[73] Assignee: Sumitomo Wiring Systems, Ltd., Japan

[21] Appl. No.: 138,324

[22] Filed: Dec. 28, 1987

[30] Foreign Application Priority Data

Dec. 27, 1987 [JP] Japan ..... 62-315273

[51] Int. Cl.[4] ..... H01B 7/22

[52] U.S. Cl. ..... 174/108; 156/51; 156/55; 156/56; 174/131 A; 338/214

[58] Field of Search ..... 156/51, 55, 56, 172; 174/102 SC, 108, 131 A; 338/214

[56] References Cited

U.S. PATENT DOCUMENTS 3,425,865 2/1969 Shelton ..... 156/56 X
3,582,417 6/1971 Plate et al. ..... 156/51
3,818,412 6/1974 Deardurff ..... 174/102 SC X
4,375,632 3/1983 Miyamoto et al. ..... 338/214
4,689,601 8/1987 Coffey et al. ..... 338/214

*Primary Examiner*—Robert A. Dawson
*Attorney, Agent, or Firm*—Jordan B. Bierman

[57] ABSTRACT

A method for the manufacture of a high tension ignition cable wherein a tension member is passed through an extruder to form a settable plastic layer thereon. This extrusion takes place under conditions such that substantially no setting of the plastic layer occurs. Thereafter, winding a resistive conductor around the plastic layer to form a plurality of coils at least partially embedded in the layer. The coils are then coated with an insulation layer and a plastic layer is caused to set, thereby fixing the coils in position so that they do not move. The cable made by the foregoing process is also described.

19 Claims, 1 Drawing Sheet

HIGH TENSION CABLE AND METHOD OF MANUFACTURE THEREOF

This application claims the priority of Japanese 315273/1987, filed Dec. 17, 1986.

The present invention is directed to a method for producing cable, more specifically, a method for making high tension ignition cable. The invention also includes the cable which is the product of the foregoing method.

BACKGROUND OF THE INVENTION

In the conventional method of making high tension ignition cable, there is provided a center tension member upon which the remaining layers are fixed. The tension member is passed through an extrusion device and a plastic layer is applied thereto. This layer may contain ferromagnetic material such as ferrite powder. The tension member is made of materials having a high tensile strength.

The materials of which the plastic layer is composed are silicone rubber, chlorinated polyolefinic elastomers, including chlorinated polyethylene, and the like. After being extruded over the tension member, they are cross-linked at elevated temperatures and pressures.

Once the foregoing is accomplished, a wire, usually a resistive conductor, is coiled around the cross-linked plastic layer. Thereafter, an insulation layer, a braid, and a plastic sheath are applied successively to the cable.

In recent times, it has been found desirable to increase the inductance of the cable per unit length. In order to accomplish this, it is important that the coils of the wire or resistive conductor be wound more closely around the plastic layer in order to provide a greater number of turns.

However, a problem has arisen in this regard. It has been found that the coils of resistive conductor are easily deformed by the extrusion of the insulation layer; this results in variations in coil alignment and, in some cases, produces actual contact between-adjacent coils. This, of course, makes it very difficult to maintain the desired design inductance throughout the cable length.

There have been attempts at solving this problem. For example, Japanese Utility Model Unexamined Publication No. 146,812/84 teaches a coil configuration wound around a crosslinked plastic layer having fin-like portions which, project outwardly from, and extend longitudinally of, the cable surface. The combination of very tight coil winding and the aforementioned fins are relied on to prevent or minimize the undesired movement of the coils.

In Japanese Patent Unexamined Publication No. 106,884/79, the resistive conductor is wound tightly over a heated, softened surface of the plastic layer and thereby embedded therein. The coils are maintained under tension until the insulation surface is chilled.

Neither of the foregoing were successful in achieving an unchanged coil structure after extrusion of the sheath elastomer. In the first case, an extremely high tension on the resistive conductor is necessary in order to obtain a rigid coil structure. This, of course, causes breakage and creates other problems.

In the second case, the coil structure is also non-uniform, but for a different reason. It is not feasible to uniformly soften the elastomer surface so that the embedding of the coils takes place evenly.

As a result of the lack of stability of the prior art cables, it is difficult to make oridinary cable connections between segments thereof. It is desirable to make such connections by simply removing the outer layers (e.g. the insulating layer, braid, and sheath) from the core without disturbing the coil structure.

BRIEF DESCRIPTION OF THE INVENTION

It is, therefore, among the objects of this invention to provide a method for making a high tension ignition cable which has increased inductance per unit length and is suitable for connection in the usual manner.

It is also among the objects of this invention to provide a cable wherein the coils of resistive conductor are stable, even when subjected to extrusion of additional outer layers.

The foregoing objects are achieved by passing the tension member through an extruder to form a settable plastic layer thereon under conditions such that substantially no setting of the plastic layer occurs. The wire (e.g. resistive conductor) is coiled closely around the plastic to form a plurality of coils. Since the plastic layer is uncured, the coils embed readily and evenly into the layer. Thereafter, an insulation layer is extruded over the coils and the plastic layer is caused to set.

The manner of setting is not critical, and can be curing, vulcanization, crosslinking, etc. Once setting has occurred, the coils of wire are firmly held by the plastic layer and any undesired movement thereof is substantially prevented.

As the tension member, aromatic polyamide fiber yarns have been found particularly suitable. The resistive conductor is advantageously made of Nichrome (Ni-Cr-Fe alloy) or stainless steel. As previously indicated, it is coiled around the plastic layer before the latter is cured or set.

It has also been found that a particularly suitable plastic layer is composed of a fluoro elastomer, ferromagnetic material, a vulcanizing agent, and optionally an anti-oxidant. Of course, the usual fillers and additives may be cinluded for their known purposes and effects.

It has been found particularly suitable to cause both the insulating layer and the plastic layer to set at the same time by vulcanizing them at elevated temperature in a steam atmosphere.

BRIEF DESCRIPTION OF THE DRAWINGS

In the accompanying drawings, constituting a part hereof, and in which like reference characters indicate like parts.

DETAILED DESCRIPTION OF THE INVENTION

Figure 4:
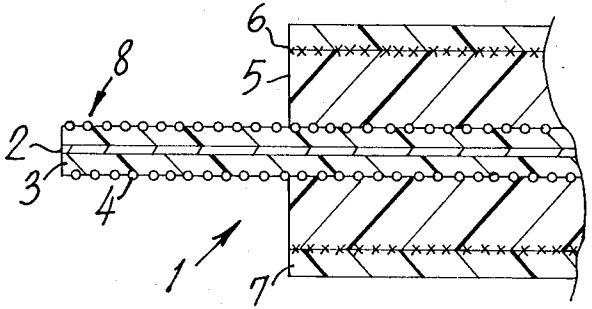
FIG. 4 is a sectional view of a cable made in accordance with the present invention.

Referring FIG. 4 cable 1 has tension member 2 as the central portion thereof. Plastic layer 3 surrounds tension member 2 and has wire 4 coiled therearound and embedded therein. Tension member 2, plastic layer 3, and wire 4 comprise cable core 8. Core 8 is surrounded by insulation layer 5 which, in turn, carries braid 6. Sheath 7 is placed thereover to complete the cable.

Figure 1:
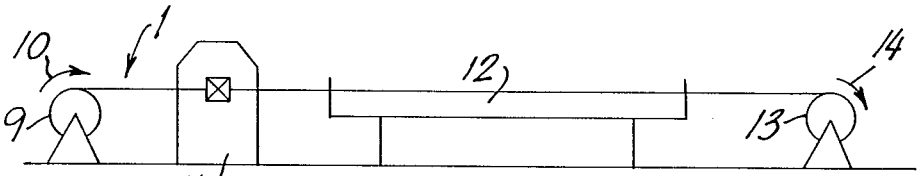
FIG. 1 is a schematic diagram showing the method of extruding the plastic layer over the tension member in accordance with the present invention.

In FIG. 1, tension member 2 is conveyed from supply spool 1, which turns in the direction of arrow 10, through first extruder 11. At this point, plastic layer 3 is caused to surround tension member 2. The conditions of extrusion are such that, although the materials of which plastic layer 3 is made are settable, no such setting occurs. The cable is then conducted through cooling bath 12 and is wound onto take-up spool 13.

Tension member 2 can be any one of a wide variety of materials which have the desired tensile strength to support the finished cable. It is advantageously made from such fibrous materials as Kevlar (a product of DuPont), glass fibers, or boron fibers. Although the form of member 2 is not critical, it is preferably in the form of yarns or strands.

For the fluorinated elastomer which is an ingredient of plastic layer 3, Aflas, grade 150E or 150L (products of Asahi Glass Kogyo, Japan) has been found suitable. The preferred composition of the plastic layer is as follows.

| Ingredients | Parts by Weight |
|---|---|
| Aflas 150 E | 100 |
| BSF 547 (manganese-zinc-ferrite powder of Toda Kogyo, K. K.) | 200 to 600 |
| Vulcanizing agent | 0.5 to 3.0 |
| Anti-oxidizing agent | 1 to 3 |

Most preferred is a fluorinated elastomer compound wherein the weight ratio of ferromagnetic powder to elastomer is about 4 to 1.

The extrusion as shown in FIG. 1 was carried out at a temperature not exceeding about 100° C. at the die and nipple of the extruder in order to avoid crosslinking of the plastic layer.

Figure 2:
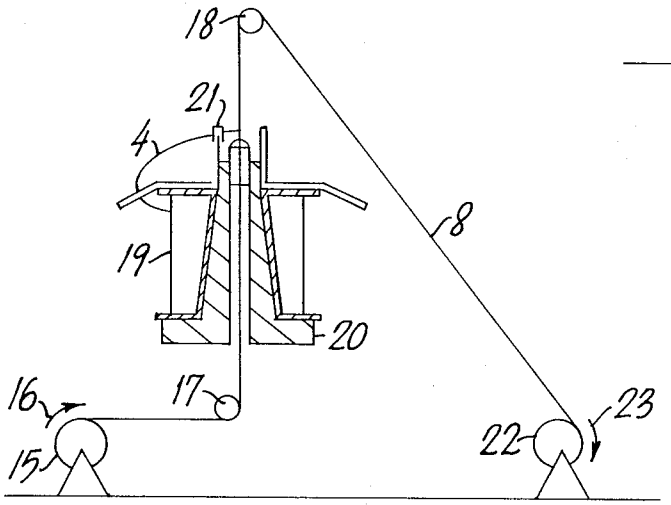
FIG. 2 is a schematic view, partly in section, showing the winding process for application of the resistive conductor to the plastic layer.

Referring now to FIG. 2, the mechanism and method for winding wire 4 around plastic layer 2 is shown. The combination of tension member 2 and plastic layer 3, which is the product of the extrusion of FIG. 1, is fed from supply roller 15 in the direction of arrow 16 by capstans 17 and 18 through rotor head 20. Wire 4 (resistive conductor) is fed from supply bobbin 19 through wire guide 21 which revolves around the center line of rotor head 20 and coils wire 4 around plastic layer 2 to form cable core 8. Cable core 8, after passing around capstan 18, is wound onto take up roller 22 in the direction of arrow 23.

Wire 4, as previously indicated, is preferably made of Nichrome, Manganin or stainless steel. It is, of course, desirable that the coils of wire 4 be laid very close to one another so that the maximum inductance is obtained.

Since plastic layer 3 has not yet been caused to set, its plasticity readily permits the wound coils to be embedded therein. Thus, smooth, even, and closely laid coils of wire 4 are obtained on the outer surface of plastic layer 3. These coils leave a slight roughness so that the second extrusion of insulation layer 5 can evenly and easily be applied without appreciable movement of the coils.

Figure 3:
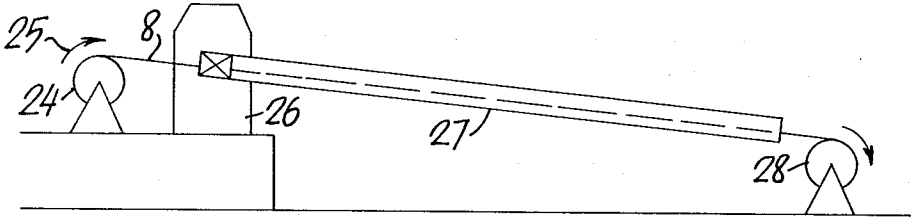
FIG. 3 is a view similar to that of FIG. 1 showing the method of extruding the insulation layer over the coiled resistive conductor.

FIG. 3 shows the method of providing cable core 8 with insulation layer 4. Core 8 from FIG. 2 is fed from supply spool 24 in the direction of arrow 25 through second extruder 26. The composition forming insulation layer 5 is charged into extruder 26. This material comprises a polymer compound which is preferably a thermoplastic material. Also, there is a setting (crosslinking or vulcanizing) agent, as well as, if desired, an anti-oxidizing agent, or inorganic or organic fillers, or other additives. Advantageously, the thermoplastic polymeric material is EPDM (a crosslinkable ethylene/propylene terpolymer with dienes such as 1,4-hexadiene, dicyclopentadiene, and 2-ethylidene-5-norbornene), polyethylenes, or silicone resins.

Cable core 8 having insulation layer 5 thereon is then passed through vulcanizer 27. There, the product is subjected to continuous heat treatment at about 200° C. for approximately 40 seconds under a steam atmosphere. Vulcanization of both plastic layer 3 and insulation layer 5 takes place simultaneously. The vulcanized product is wound up on take up reel 28. The product may then have braid 6 applied thereover, followed by sheath 7.

Referring again to FIG. 4, at the left side, insulation layer 4, braid 5, and sheath 6 have been removed from the cable in order to facilitate a connection thereof. Since cable core 8 and plastic layer 3 are tightly integrated by the closely wound coils of wire 4 embedded in plastic layer 3, a smooth, even surface is provided. Therefore, removal of insulation layer 5 (as well as braid 6 and sheath 7) can be carried out quite easily, without disturbing the coil structure. Hence, cables of the present invention are able to be connected with, for example, a metallic terminal by such conventional methods as crimping as described in U.S. Pat. Nos. 3,787,800 and 3,284,751.

Since plastic layer 3 was not crosslinked or set when the coil structure was formed, it permits the winding of resistive conductors as fine as 20 to 100 microns in very close coils. Had plastic layer 3 been set at this point, the turns of wire would not have been embedded in the layer, since it would have been too solid to permit this.

It has been known that a large amount of magnetic material incorporated into plastic layer 3 will improve the noise attenuation characteristics of the cable. However, it normally causes the physical properties of layer 3 to deteriorate. However, in the case of the present invention, it has been found that the crosslinked fluorinated elastomer maintains a tensile strength of approximately 40kgs and an elongation of 200%, even if 400 parts by weight of powdered ferrite are mixed with only 100 parts by weight of the elastomer.

It can thus be seen that the present invention provides a high tension ignition cable having increased inductance due to the closely wound coil structure thereof. In addition, excellent attenuation characteristics from the ferromagnetic ingredients, coupled with very desirable physical properties, are also obtained. In addition, cable connections by means of the usual removal of insulation can readily be carried out.

Although only a limited number of specific embodiments of the present invention have been expressly disclosed, it is, nonetheless, to be broadly construed, and not to be limited except by the character of the claims appended hereto.

WHAT WE CLAIM IS

1. A method of making a cable comprising passing a tension member through an extruder to form a settable plastic layer thereon under conditions such that substantially no setting of said plastic layer occurs, thereafter, winding a wire around said plastic layer to form a plurality of coils at least partially embedded in said plastic layer, thereafter extruding an insulation layer over said coils, and causing said plastic layer to set.

2. The method of claim 1 wherein said insulating layer is settable, said extruding takes place without setting said insulating layer, and said causing also sets said insulating layer.

3. The method of claim 1 wherein said wire is a resistive conductor.

4. The method of claim 1 wherein said winding takes place under sufficient tension to at least partially embed said conductor in said plastic layer.

5. The method of claim 1 further comprising covering said insulating layer with a braid.

6. The method of claim 5 wherein said braid is of organic and/or inorganic yarn.

7. The method of claim 5 further comprising applying an outer sheath to said braid.

8. The method of claim 1 wherein said tension member is yarn or strands of polymeric material.

9. The method of claim 1 wherein said plastic layer is caused to set by vulcanization and/or crosslinking.

10. The method of claim 1 wherein said plastic layer comprises a fluoro elastomer, a vulcanizing agent, and powdered ferromagnetic material.

11. The method of claim 10 wherein said plastic layer comprises, per 100 parts by weight of said elastomer, 200 to 600 parts by weight of ferrite powder and 0.5 to 3 parts of vulcanizing agent.

12. The method of claim 11 wherein there is also present 1 to 3 parts by weight of antioxidant.

13. The method of claim 1 wherein said conductor is Nichrome, Manganin and/or stainless steel.

14. The method of claim 1 wherein said insulation layer is a settable resin taken from the class consisting of polyethylene, ethylene propylene dienes, and silicone resins.

15. The method of claim 1 wherein said extruding of said insulation layer takes place under conditions which cause complete setting of said plastic layer.

16. The method of claim 1 wherein said cable is a high tension ignition cable.

17. A cable which is the product of the method of claim 1.

18. The method of claim 9 wherein said vulcanization takes place at elevated temperatures in a steam atmosphere.

19. The method of claim 1 wherein said wire is only partially embedded in said plastic layer.

* * * * *